US010209040B2

(12) United States Patent
Xue

(10) Patent No.: US 10,209,040 B2
(45) Date of Patent: Feb. 19, 2019

(54) SHAPED CHARGE HAVING A RADIAL MOMENTUM BALANCED LINER

(71) Applicant: Halliburton Energy Services, Inc., Houston, TX (US)

(72) Inventor: Zhenyu Xue, Sugar Land, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 145 days.

(21) Appl. No.: 15/119,618

(22) PCT Filed: Apr. 18, 2014

(86) PCT No.: PCT/US2014/034619
§ 371 (c)(1),
(2) Date: Aug. 17, 2016

(87) PCT Pub. No.: WO2015/160360
PCT Pub. Date: Oct. 22, 2015

(65) Prior Publication Data
US 2017/0052004 A1 Feb. 23, 2017

(51) Int. Cl.
*E21B 43/117* (2006.01)
*F42B 1/028* (2006.01)

(52) U.S. Cl.
CPC ..... *F42B 1/028* (2013.01); *E21B 43/117* (2013.01)

(58) Field of Classification Search
CPC ..... E21B 43/117; F42B 1/028
See application file for complete search history.

(56) References Cited

U.S. PATENT DOCUMENTS

| | | | | |
|---|---|---|---|---|
| 4,466,353 | A | 8/1984 | Grace | |
| 6,443,068 | B1 * | 9/2002 | Meister | F42B 1/028 102/306 |
| 6,840,178 | B2 | 1/2005 | Collins et al. | |
| 7,172,023 | B2 | 2/2007 | Barker et al. | |
| 7,547,345 | B2 | 6/2009 | Leidel et al. | |
| 7,600,476 | B1 | 10/2009 | Baker et al. | |
| 7,811,354 | B2 | 10/2010 | Leidel et al. | |
| 8,616,130 | B2 | 12/2013 | Daoud | |
| 2002/0017214 | A1 | 2/2002 | Jacoby et al. | |
| 2003/0183113 | A1 | 10/2003 | Barlow et al. | |
| 2010/0319562 | A1 | 12/2010 | Yang | |
| 2011/0232519 | A1 | 9/2011 | Sagebiel | |

OTHER PUBLICATIONS

International Search Report and the Written Opinion of the International Search Authority, dated Jan. 15, 2015, PCT/US2014/034619, 8 pages, ISA/KR.

* cited by examiner

*Primary Examiner* — Brad Harcourt

(57) ABSTRACT

A disclosed example embodiment includes a shaped charge for use in a well perforating system. The shaped charge includes a housing having a discharge end and an initiation end. A liner is positioned with the housing. A main explosive is positioned within the housing between the liner and the initiation end of the housing. The liner has a radially outwardly disposed concave section having a progressively decreasing wall thickness in the direction from the initiation end to the discharge end of the housing and a radially inwardly disposed convex section having a progressively increasing wall thickness in the direction from the initiation end to the discharge end of the housing such that the liner is radial momentum balanced and operable to form a coherent jet having a hollow leading edge following detonation of the shaped charge.

9 Claims, 5 Drawing Sheets

SHAPED CHARGE HAVING A RADIAL MOMENTUM BALANCED LINER

PRIORITY

The present application is a U.S. National Stage patent application of International Patent Application No. PCT/US2014/034619, filed on Apr. 18, 2014, the benefit of which is claimed and the disclosure of which is incororated herein by reference in its entirety.

TECHNICAL FIELD OF THE DISCLOSURE

This disclosure relates, in general, to equipment utilized in conjunction with operations performed in relation to subterranean wells and, in particular, to a shaped charge having a radial momentum balanced liner operable to form a coherent jet having a hollow leading edge for use in perforating a wellbore casing.

BACKGROUND

Without limiting the scope of the present disclosure, its background will be described with reference to perforating a cased wellbore with a perforating gun assembly, as an example.

After drilling each section of a wellbore that traverses various subterranean formations, individual lengths of relatively large diameter metal tubulars are typically secured together to form a casing string that is positioned within the wellbore. In addition to providing a sealing function, the casing string provides wellbore stability to counteract the geomechanics of the formations such as compaction forces, seismic forces and tectonic forces, thereby preventing the collapse of the wellbore wall. The casing string is generally fixed within the wellbore by a cement layer that fills the annulus between the outer surface of the casing string and the wall of the wellbore. For example, once a casing string is located in its desired position in the wellbore, a cement slurry is pumped via the interior of the casing string, around the lower end of the casing string and upward into the annulus. After the annulus around the casing string is sufficiently filled with the cement slurry, the cement slurry is allowed to harden, thereby supporting the casing string and forming a substantially impermeable barrier.

To produce fluids into the casing string or inject fluids into the formation, hydraulic openings or perforations must be made through the casing string, the cement and a short distance into the formation. Typically, these perforations are created by detonating a series of shaped charges that are disposed within the casing string and are positioned adjacent to the desired formation. Specifically, one or more charge carriers are loaded with shaped charges that are connected with a detonating cord. The charge carriers are then connected within a tool string that is lowered into the cased wellbore at the end of a tubing string, wireline, slick line, electric line, coil tubing or other conveyance. Once the charge carriers are properly positioned in the wellbore such that the shaped charges are adjacent to the interval to be perforated, the shaped charges are detonated. Upon detonation, each shaped charge generates a high-pressure stream of metallic particles in the form of a jet that penetrates through the casing, the cement and into the formation with the goal of forming an effective communication path for fluids between the reservoir and the wellbore.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While various system, method and other embodiments are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure.

Figure 1:
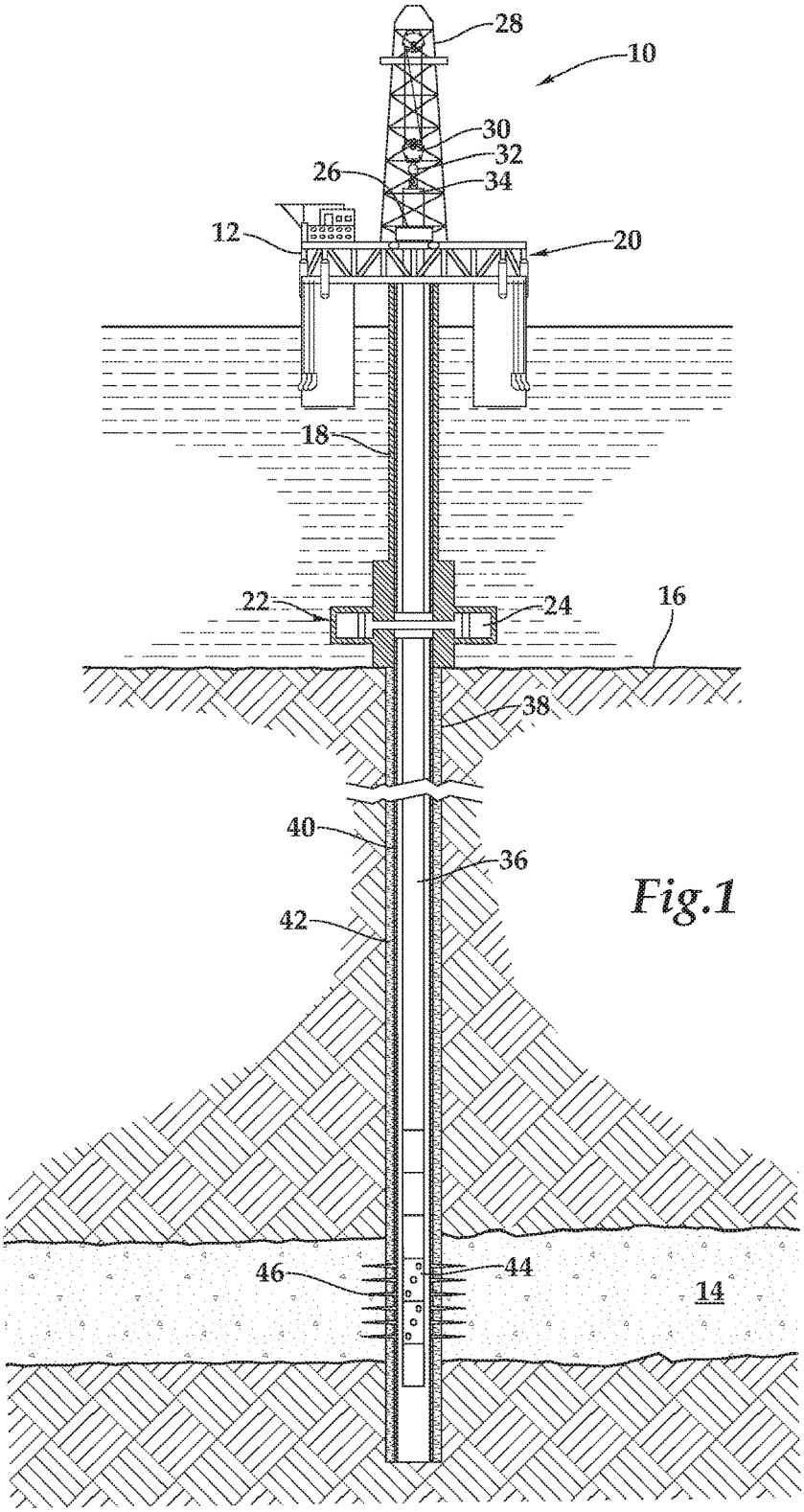
FIG. 1 is a schematic illustration of an offshore oil and gas platform operating a perforating system including shaped charges having radial momentum balanced liners according to an embodiment of the present disclosure.

Referring initially to FIG. 1, a perforating system is being operated from an offshore oil and gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including subsea blow-out preventers 24. Platform 12 has a hoisting apparatus 26, a derrick 28, a travel block 30, a hook 32 and a swivel 34 for raising and lowering pipe strings, such as work string 36. A wellbore 38 extends through the various earth strata including formation 14. A casing 40 is secured within wellbore 38 by cement 42. On the lower end of work string 36 are various tools such as a tandem perforating gun assembly 44. When it is desired to perform a perforation operation, work string 36 is lowered through casing 40 until perforating gun assembly 44 is properly positioned relative to formation 14 and the pressure within wellbore 38 is adjusted to the desire pressure regime, for example, static overbalanced, static underbalanced or static balanced. Thereafter, shaped charges having radial momentum balanced liners that are carried by perforating gun assembly 44 are detonated such that the liners form coherent jets having hollow leading edges that create a spaced series of perforations 46 extending outwardly through casing 40, cement 42 and into formation 14, thereby allowing fluid communication between formation 14 and wellbore 38.

Even though FIG. 1 depicts a vertical wellbore, the systems and methods of the present disclosure are equally well suited for use in wellbores having other directional orientations including deviated wellbores, horizontal wellbores, multilateral wellbores or the like. Accordingly, the use of directional terms such as above, below, upper, lower, upward, downward, uphole, downhole and the like are used in relation to the illustrative embodiments as they are depicted in the figures, the uphole direction being toward the top or the left of the corresponding figure and the downhole direction being toward the bottom or the right of the corresponding figure. Also, even though FIG. 1 depicts an offshore operation, the systems and methods of the present disclosure are equally well suited for use in onshore operations. In addition, even though a single tandem tubing conveyed perforating gun assembly has been depicted, any arrangement of perforating guns on any type of conveyance may be utilized without departing from the principles of the present disclosure.

Figure 2:
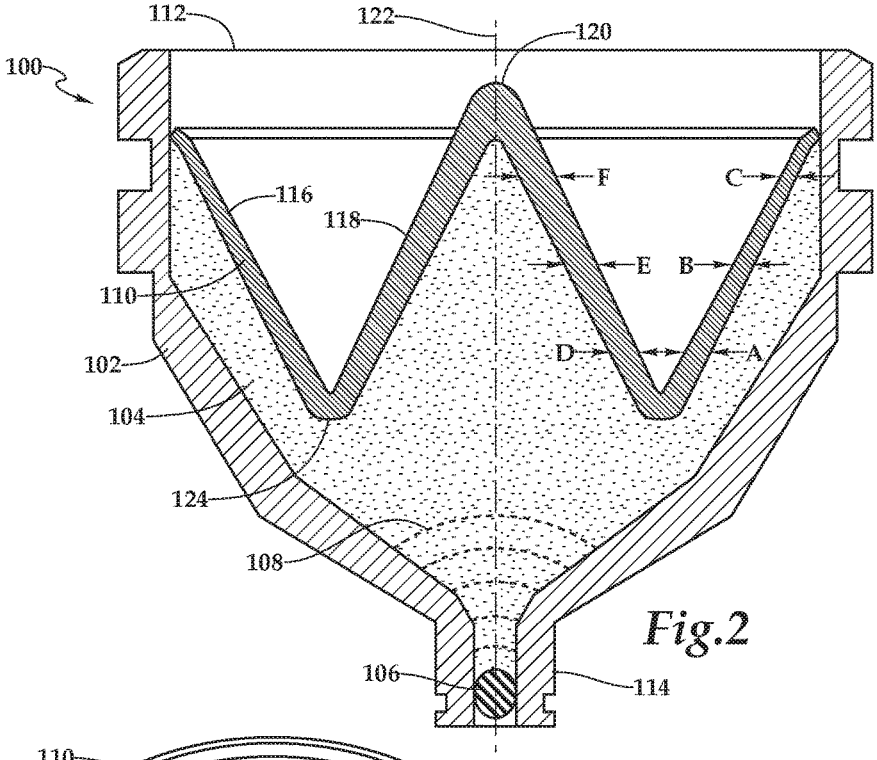
FIG. 2 is a cross sectional view of a shaped charge having a radial momentum balanced liner according to an embodiment of the present disclosure.

FIG. 2 is a cross sectional view of a shaped charge 100 according to the present disclosure. Shaped charge 100 has a generally cylindrically shaped housing 102 that may be formed from a metal such as steel, zinc or aluminum or other suitable material such as a ceramic, glass or plastic. A quantity of high explosive powder depicted as main explosive 104 is disposed within housing 102. Main explosive 104 may be any suitable explosive used in shaped charges such as the following, which are sold under trade designations HMX, HNS, RDX, HTX, PYX, PETN, PATB, HNIW and TNAZ. In the illustrated embodiment, main explosive 104 is detonated using an point source initiator depicted as detonating cord 106 that generates a single point detonation wave 108 (depicted in phantom lines) upon detonation. A booster explosive (not shown) may be used between detonating cord 106 and main explosive 104 to efficiently transfer the detonating signal from detonating cord 106 to main explosive 104. A waveshaper (not shown) may be positioned within main explosive 104 to direct the path of detonation wave 108 if desired.

A liner 110 is positioned toward the discharge end 112 of housing 102. As illustrated, main explosive 104 is positioned between a lower surface of liner 110 and the initiation end 114 of housing 102. Main explosive 104 may fill the entire volume therebetween or certain voids may be present if desired. Liner 110 may be formed by sheet metal or powdered metal processes and may include one or more metals such as copper, aluminum, tin, lead, brass, bismuth, zinc, silver, antimony, cobalt, nickel, molybdenum, tungsten, tantalum, uranium, cadmium, cobalt, magnesium, zirconium, beryllium, gold, platinum, alloys and mixtures thereof as well as mixtures including plastics, polymers, binders, lubricants, graphite, oil or other additives.

Figure 3A:
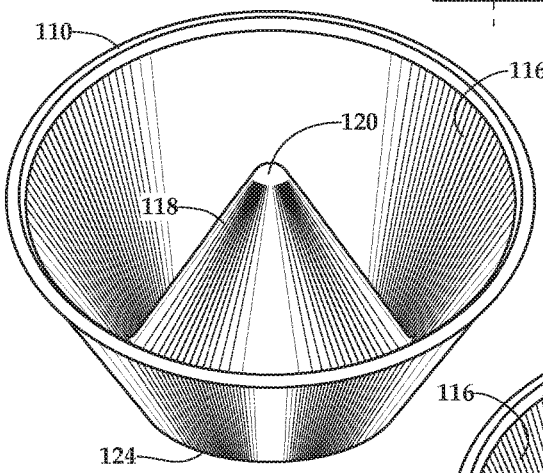
FIGS. 3A-3B are isometric and exploded views of a radial momentum balanced liner according to an embodiment of the present disclosure.
Figure 3B:
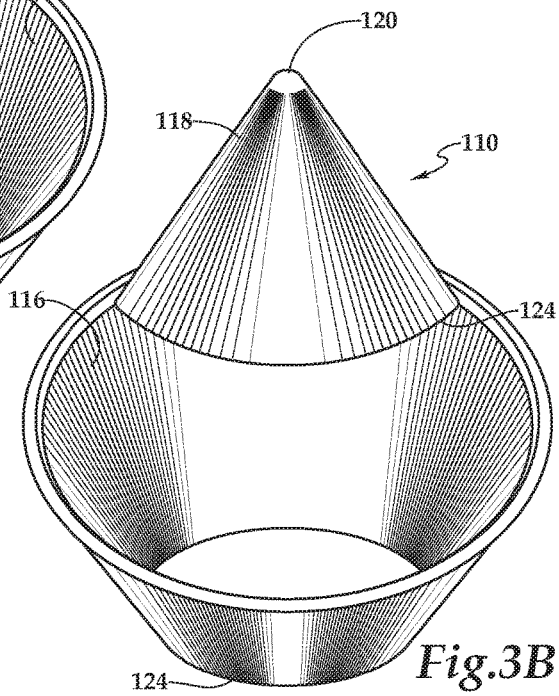

As best seen in FIGS. 3A-3B, the radially outer portion of liner 110 is a truncated conical section 116 that is concave relative to discharge end 112 of housing 102. The radially inner portion of liner 110 is a conical section 118 that is convex relative to discharge end 112 of housing 102. In the illustrated embodiment, conical section 118 has an apex 120 pointing generally in the direction from the discharge end 114 to the initiation end 112 of housing 102 along a central axis 122. Optionally, apex 120 could include an apex hole (not shown). As illustrated, the interface between radially outwardly disposed concave section 116 and radially inwardly disposed convex section 118 forms an annular apex 124 pointing generally in the direction from the discharge end 114 to the initiation end 112 of housing 102 and parallel to central axis 122. Together, radially outwardly disposed concave section 116 and radially inwardly disposed convex section 118 form an annular liner 110 that is symmetric about central axis 122 and that has a cross sectional shape of generally side-by-side or dual Vs, as best seen in FIG. 2.

To achieve the desired result of forming a coherent jet having a hollow leading edge following detonation of shaped charge 100, liner 110 is radial momentum balanced by varying the thickness of liner 110 such that liner particles from radially outwardly disposed concave section 116 traveling in the radially inward direction have the same, substantially the same or similar radial momentum as liner particles from radially inwardly disposed convex section 118 traveling in the radially outward direction. In the illustrated embodiment, radially outwardly disposed concave section 116 has a progressively decreasing wall thickness in the direction from the initiation end 114 to the discharge end 112 of housing 102. For example, the thickness of liner 110 at location A is greater than the thickness of liner 110 at location B which is greater than the thickness of liner 110 at location C. Likewise, radially inwardly disposed convex section 118 has a progressively increasing wall thickness in the direction from the initiation end 114 to the discharge end 112 of housing 102. For example, the thickness of liner 110 at location D is less than the thickness of liner 110 at location E which is less than the thickness of liner 110 at location F. As such, in the illustrated embodiment, the thickness of liner 110 becomes progressively smaller moving radially outwardly from central axis 122. Likewise, the thickness of liner 110 becomes progressively greater moving radially inwardly toward central axis 122.

Depending upon the desired jet configuration, the wall thickness of radially outwardly disposed concave section 116 may decrease linearly or nonlinearly in the direction from the initiation end 114 to the discharge end 112 of housing 102. Likewise, the wall thickness of radially inwardly disposed convex section 118 may increase linearly or nonlinearly in the direction from the initiation end 114 to the discharge end 112 of housing 102. The exact wall thickness progressions can be determined using numerical methods such as hydrocode computational modeling taking into account such factors as liner material, liner configuration, main explosive type, main explosive configuration, housing material, housing configuration, propagation of the detonation wave and other factors known to those skilled in the art.

Figure 4A:
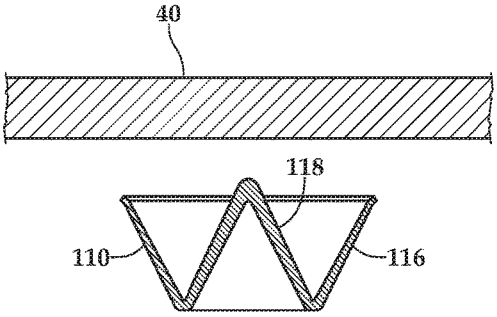
FIGS. 4A-4F are sequential cross sectional views of a radial momentum balanced liner forming a coherent jet having a hollow generally cylindrical shape that creates an opening in a target according to an embodiment of the present disclosure.
Figure 4B:
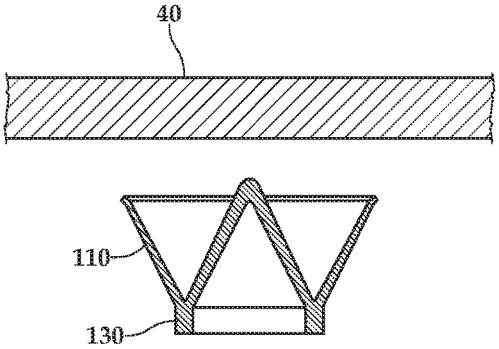
Figure 4C:
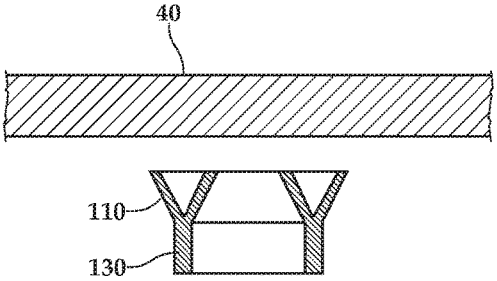
Figure 4D:
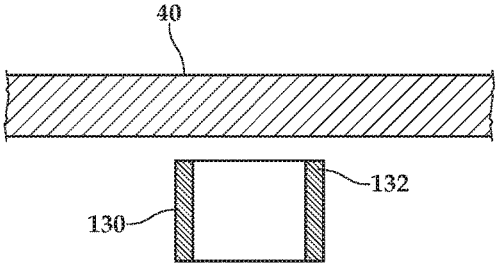
Figure 4E:
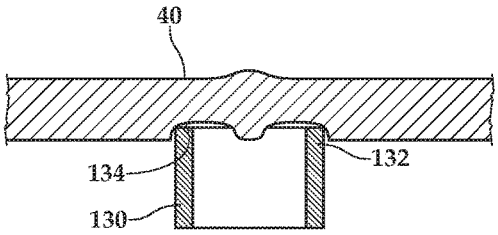
Figure 4F:
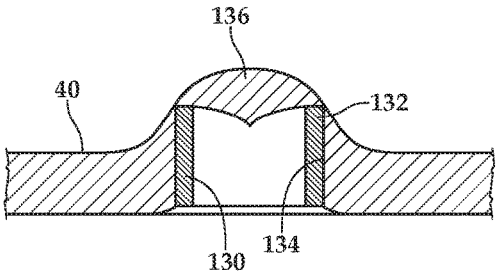

FIGS. 4A-4F are sequential cross sectional views of a radial momentum balanced liner forming a coherent jet having a hollow generally cylindrical shape that creates an opening in a target according to an embodiment of the present disclosure. In FIGS. 4A-4F, the housing and main explosive of the shaped charge has been removed to better reveal the operation of the liner forming the jet. FIG. 4A depicts liner 110 positioned relative to a target such a section of casing string 40 at a time T0 prior to the detonation event. FIG. 4B depicts liner 110 at a time T1 after initiation of the detonation event, wherein a lower portion of liner 110 is beginning to form a coherent cylindrical jet 130. FIG. 4C depicts liner 110 at a time T2 after initiation of the detonation event, wherein an additional portion of liner 110 is forming a coherent cylindrical jet 130 and is beginning to move toward target 40. FIG. 4D depicts liner 110 at a time T3 after initiation of the detonation event, wherein the entire liner 110 has formed a coherent cylindrical jet 130 that is moving toward target 40 and that has a hollow leading edge 132. FIG. 4E depicts coherent cylindrical jet 130 at a time T4 after initiation of the detonation event, wherein hollow leading edge 132 has contacted target 40 and is beginning to form an opening 134 in target 40. FIG. 4F depicts coherent cylindrical jet 130 at a time T5 after initiation of the detonation event, wherein coherent cylindrical jet 130 has formed opening 134 through target 40 including expelling a fragment 136 of the material of target 40. As illustrated, an annular liner 110 that is symmetric about central axis 122 and is radial momentum balanced is operable to form a coherent jet having a hollow leading edge. This jet configuration enables a relatively large opening 134 to be created through target 40 compared to conventional shaped charges having liners of similar mass configured as conical liners, hemispherical liners, truncated hemispherical liners, dish shaped liners, tulip liners, trumpet liners, dual angle conical liners, hemi-cone liners or the like. Specifically, using conventional liners, the jet formed upon detonation has its entire mass concentrated together in the form of a solid jet or solid slug projectile whereas the jet of the present disclosure includes a hollow leading edge spreading the mass of the liner to enable formation of a larger opening.

Figure 5:
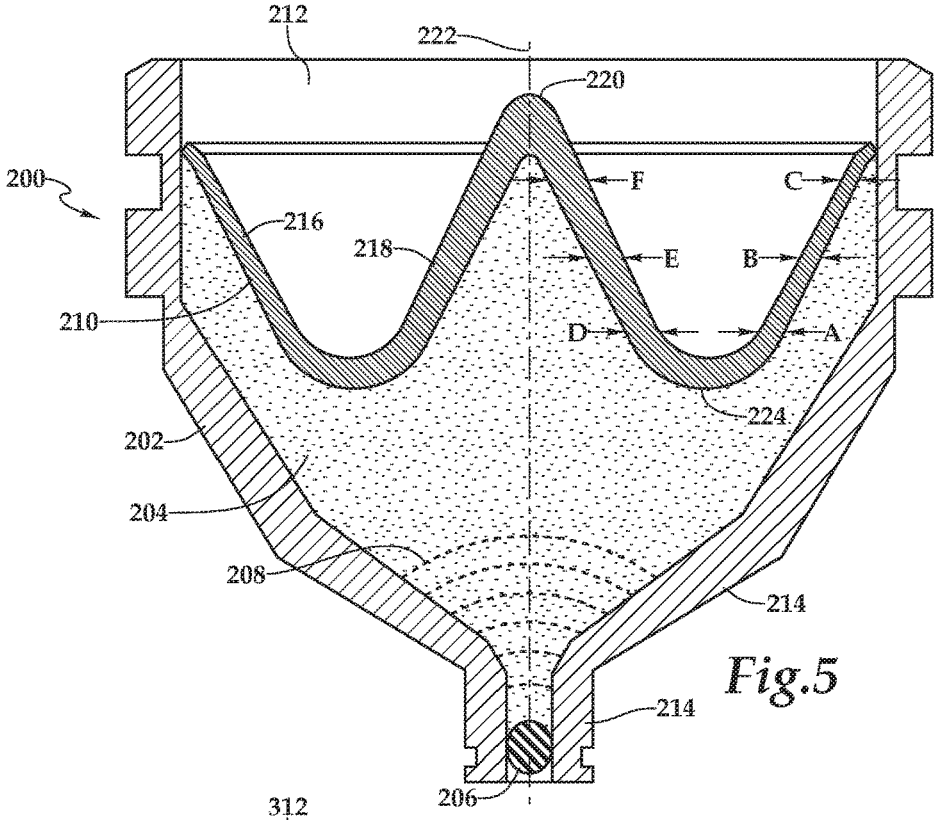
FIG. 5 is a cross sectional view of a shaped charge having a radial momentum balanced liner according to an embodiment of the present disclosure.

While a particular liner geometry has been depicted and described, an annular liner that is symmetric about its central axis could have a variety of cross sectional shapes including dual semi-circles, dual truncated semi-circles, dual semi-ovals, dual truncated semi-ovals, dual curves, dual tulip, dual trumpets, dual multi-angle Vs as well as other dual shaped charge liner geometries. For example, FIG. 5 is a cross sectional view of a shaped charge 200 according to the present disclosure. Shaped charge 200 has a generally cylindrically shaped housing 202, a quantity of high explosive powder depicted as main explosive 204 and a detonating cord 206 that generates a single point detonation wave 208 (depicted in phantom lines) upon detonation. A liner 210 is positioned toward the discharge end 212 of housing 202. As illustrated, main explosive 204 is positioned between a lower surface of liner 210 and the initiation end 214 of housing 202.

The radially outer portion 216 of liner 210 is a truncated conical section with a lower portion that is a partial hemisphere that is concave relative to discharge end 212 of housing 202. The radially inner portion 218 of liner 210 is a conical section with a lower radiused portion that is convex relative to discharge end 212 of housing 202. In the illustrated embodiment, conical section 218 has an apex 220 pointing generally in the direction from the discharge end 214 to the initiation end 212 of housing 202 along a central axis 222. Optionally, apex 220 could include an apex hole (not shown). As illustrated, the interface between radially outwardly disposed concave section 216 and radially inwardly disposed convex section 218 forms an annular apex 224. Together, radially outwardly disposed concave section 216 and radially inwardly disposed convex section 218 form an annular liner 210 that is symmetric about central axis 222 that has a cross sectional shape of generally side-by-side or dual Vs having partially hemispherical apexes.

To achieve the desired result of forming a coherent jet having a hollow leading edge following detonation of shaped charge 200, liner 210 is radial momentum balanced by varying the thickness of liner 210. In the illustrated embodiment, radially outwardly disposed concave section 216 has a progressively decreasing wall thickness in the direction from the initiation end 214 to the discharge end 212 of housing 202. For example, the thickness of liner 210 at location A is greater than the thickness of liner 210 at location B which is greater than the thickness of liner 210 at location C. Likewise, radially inwardly disposed convex section 218 has a progressively increasing wall thickness in the direction from the initiation end 214 to the discharge end 212 of housing 202. For example, the thickness of liner 210 at location D is less than the thickness of liner 210 at location E which is less than the thickness of liner 210 at location F. As such, in the illustrated embodiment, the thickness of liner 210 becomes progressively smaller moving radially outwardly from central axis 222. Likewise, the thickness of liner 210 becomes progressively greater moving radially inwardly toward central axis 222. Depending upon the desired jet configuration, the wall thickness of radially outwardly disposed concave section 216 may decrease linearly or nonlinearly in the direction from the initiation end 214 to the discharge end 212 of housing 202. Likewise, the wall thickness of radially inwardly disposed convex section 218 may increase linearly or nonlinearly in the direction from the initiation end 214 to the discharge end 212 of housing 202. The exact wall thickness progressions can be determined using numerical methods such as hydrocode computational modeling taking into account such factors as liner material, liner configuration, main explosive type, main explosive configuration, housing material, housing configuration, propagation of the detonation wave and other factors known to those skilled in the art.

Figure 6:
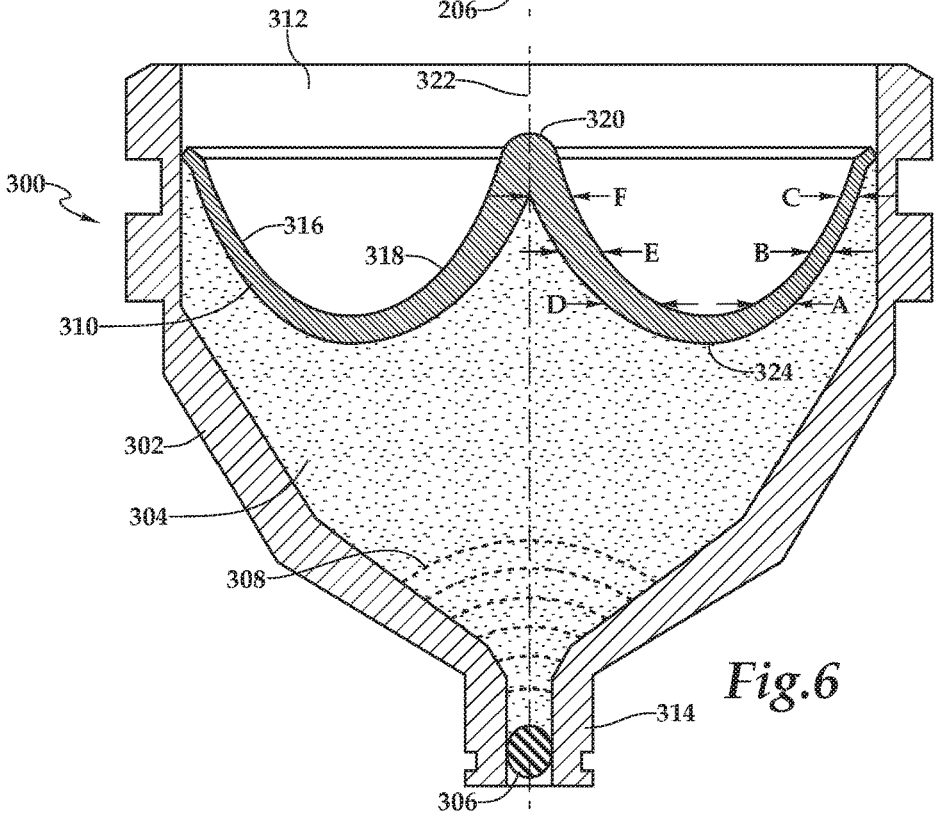
FIG. 6 is a cross sectional view of a shaped charge having a radial momentum balanced liner according to an embodiment of the present disclosure.

As another example, FIG. 6 is a cross sectional view of a shaped charge 300 according to the present disclosure. Shaped charge 300 has a generally cylindrically shaped housing 302, a quantity of high explosive powder depicted as main explosive 304 and a detonating cord 306 that generates a single point detonation wave 308 (depicted in phantom lines) upon detonation. A liner 310 is positioned toward the discharge end 312 of housing 302. As illustrated, main explosive 304 is positioned between a lower surface of liner 310 and the initiation end 314 of housing 302. The radially outer portion 316 of liner 310 is a partial hemisphere that is concave relative to discharge end 312 of housing 302. The radially inner portion 318 of liner 310 is a conical type section formed from a radially outwardly extending curve that is convex relative to discharge end 312 of housing 302. In the illustrated embodiment, section 318 has an apex 320 pointing generally in the direction from the discharge end 314 to the initiation end 312 of housing 302 along a central axis 322. Optionally, apex 320 could include an apex hole (not shown). As illustrated, the interface between radially outwardly disposed concave section 316 and radially inwardly disposed convex section 318 forms an annular apex 324. Together, radially outwardly disposed concave section 316 and radially inwardly disposed convex section 318 form an annular liner 310 that is symmetric about central axis 322 that has a cross sectional shape of generally side-by-side or dual hemispheres.

To achieve the desired result of forming a coherent jet having a hollow leading edge following detonation of shaped charge 300, liner 310 is radial momentum balanced by varying the thickness of liner 310. In the illustrated embodiment, radially outwardly disposed concave section 316 has a progressively decreasing wall thickness in the direction from the initiation end 314 to the discharge end 312 of housing 302. For example, the thickness of liner 310 at location A is greater than the thickness of liner 310 at location B which is greater than the thickness of liner 310 at location C. Likewise, radially inwardly disposed convex section 318 has a progressively increasing wall thickness in the direction from the initiation end 314 to the discharge end 312 of housing 302. For example, the thickness of liner 310 at location D is less than the thickness of liner 310 at location E which is less than the thickness of liner 310 at location F. As such, in the illustrated embodiment, the thickness of liner 310 becomes progressively smaller moving radially outwardly from central axis 322. Likewise, the thickness of liner 310 becomes progressively greater moving radially inwardly toward central axis 322. Depending upon the desired jet configuration, the wall thickness of radially outwardly disposed concave section 316 may decrease linearly or nonlinearly in the direction from the initiation end 314 to the discharge end 312 of housing 302. Likewise, the wall thickness of radially inwardly disposed convex section 318 may increase linearly or nonlinearly in the direction from the initiation end 314 to the discharge end 312 of housing 302. The exact wall thickness progressions can be determined using numerical methods such as hydrocode computational modeling taking into account such factors as liner material, liner configuration, main explosive type, main explosive configuration, housing material, housing configuration, propagation of the detonation wave and other factors known to those skilled in the art.

Figure 7:
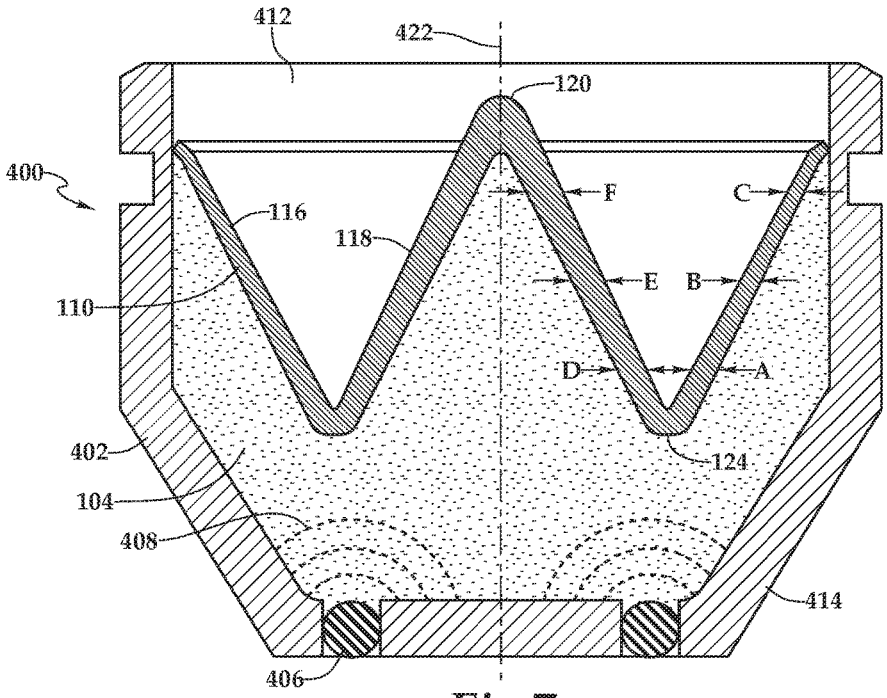
FIG. 7 is a cross sectional view of a shaped charge having a radial momentum balanced liner according to an embodiment of the present disclosure.

While a particular detonation wave geometry has been depicted and described, shaped charges of the present disclosure could have detonation waves having alternate geometries. For example, FIG. 7 is a cross sectional view of a shaped charge 400 according to the present disclosure. Shaped charge 400 has a generally cylindrically shaped housing 402, a quantity of high explosive powder depicted as main explosive 104 and an annular detonating cord 406 that generates an annular detonation wave 408 (depicted in phantom lines) upon detonation. The illustrated shaped charge 400 includes liner 110 described above that is positioned toward the discharge end 412 of housing 402 and is symmetric about central axis 422.

As illustrated, main explosive 104 is positioned between a lower surface of liner 110 and the initiation end 414 of housing 402.

Figure 8:
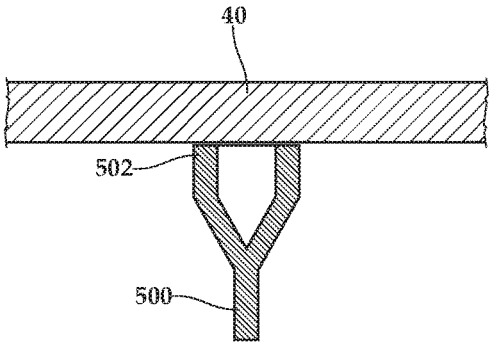
FIG. 8 is a cross sectional view of a coherent jet having a hollow leading edge prior to forming an opening in a target according to an embodiment of the present disclosure.
Figure 9:
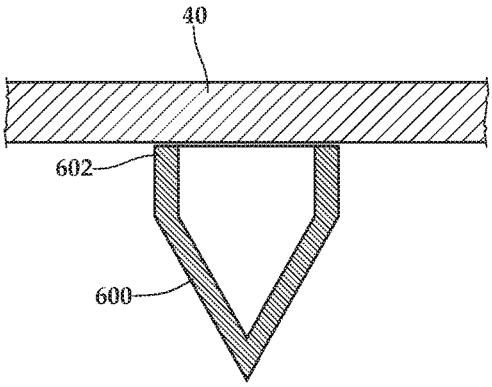
FIG. 9 is a cross sectional view of a coherent jet having a hollow leading edge prior to forming an opening in a target according to an embodiment of the present disclosure.

While a particular geometry has been depicted and described for a coherent jet having a hollow leading edge, coherent jets having hollow leading edges of the present disclosure could have alternate geometries. For example, FIG. 8 is a cross sectional view of a coherent jet 500 having a hollow leading edge 502. Jet 500 has a generally Y shaped cross section and may be generated by the detonation of a shaped charge having a liner that is at least partially radial momentum balanced. As another example, FIG. 9 is a cross sectional view of a coherent jet 600 having a hollow leading edge 602. Jet 600 has a generally V shaped cross section and may be generated by the detonation of a shaped charge having a liner that is at least partially radial momentum balanced.

In a first aspect, the present disclosure is directed to a shaped charge including a housing having a discharge end and an initiation end. A liner is positioned with the housing. A main explosive is positioned within the housing between the liner and the initiation end of the housing. The liner has a radially outwardly disposed concave section having a progressively decreasing wall thickness in the direction from the initiation end to the discharge end of the housing and a radially inwardly disposed convex section having a progressively increasing wall thickness in the direction from the initiation end to the discharge end of the housing.

In one or more embodiments of the shaped charge, an initiator, such as a point source initiator or annular source initiator, may be operably associated with the main explosive for generating a single point detonation wave or an annular detonation wave in the shaped charge; the wall thickness of the radially outwardly disposed concave section of the liner may decrease linearly or nonlinearly in the direction from the initiation end to the discharge end of the housing; the wall thickness of the radially inwardly disposed convex section of the liner may increase linearly or nonlinearly in the direction from the initiation end to the discharge end of the housing; and/or the radially outwardly disposed concave section of the liner and the radially inwardly disposed convex section of the liner may be radially momentum balanced to form a coherent jet having a hollow leading edge or a hollow generally cylindrical shape following detonation of the shaped charge.

In second aspect, the present disclosure is directed to a liner for a shaped charge having a housing with a discharge end and an initiation end and a main explosive positioned within the housing between the liner and the initiation end of the housing. The liner includes a radially outwardly disposed concave section having a progressively decreasing wall thickness in the direction from the initiation end to the discharge end of the housing and a radially inwardly disposed convex section having a progressively increasing wall thickness in the direction from the initiation end to the discharge end of the housing.

In a third aspect, the present disclosure is directed to a method of perforating a wellbore casing. The method includes detonating at least one shaped charge positioned within the wellbore casing, the at least one shaped charge including a housing having a discharge end and an initiation end, a liner positioned with the housing and a main explosive positioned within the housing between the liner and the initiation end of the housing, the liner having a radially outwardly disposed concave section having a progressively decreasing wall thickness in the direction from the initiation end to the discharge end of the housing and a radially inwardly disposed convex section having a progressively increasing wall thickness in the direction from the initiation end to the discharge end of the housing; and forming a coherent jet having a hollow leading edge.

The method may also include generating a single point detonation wave in the shaped charge; generating an annular detonation wave in the shaped charge; and/or forming a coherent jet having a hollow generally cylindrical shape.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A shaped charge comprising:

a housing having a discharge end and an initiation end;

a liner positioned with the housing, wherein, the liner has a radially outwardly disposed concave section having a progressively decreasing wall thickness in the direction from the initiation end to the discharge end and a radially inwardly disposed convex section having a progressively increasing wall thickness in the direction from the initiation end to the discharge end;

a main explosive positioned within the housing between the liner and the initiation end of the housing; and an annular source initiator operably associated with the main explosive configured to generate an annular detonation wave in the shaped charge.

2. The shaped charge as recited in claim 1 wherein the wall thickness of the radially outwardly disposed concave section of the liner decreases linearly in the direction from the initiation end to the discharge end of the housing.

3. The shaped charge as recited in claim 1 wherein the wall thickness or the radially outwardly disposed concave section of the liner decreases nonlinearly in the direction from the initiation end to the discharge end of the housing.

4. The shaped charge as recited in claim 1 wherein the wall thickness of the radially inwardly disposed convex section of the liner increases linearly in the direction from the initiation end to the discharge end of the housing.

5. The shaped charge as recited in claim 1 wherein the wall thickness of the radially inwardly disposed convex section of the liner increases nonlinearly in the direction from the initiation end to the discharge end of the housing.

6. The shaped charge as recited in claim 1 wherein the radially outwardly disposed concave section of the liner and the radially inwardly disposed convex section of the liner arc radial momentum balanced to form a coherent jet having a hollow leading edge following detonation of the shaped charge.

7. The shaped charge as recited in claim 1 wherein the radially outwardly disposed concave section of the liner and the radially inwardly disposed convex section of the liner are radial momentum balanced to form a coherent jet having a hollow generally cylindrical shape following detonation of the shaped charge.

8. A method of perforating a wellbore casing comprising:

detonating at least one shaped charge positioned within the wellbore casing, the at least one shaped charge including a housing having a discharge end and an initiation end, a liner positioned with the housing and a main explosive positioned within the housing between the liner and the initiation end of the housing, the liner having a radially outwardly disposed concave section having a progressively decreasing wall thickness in the direction from the initiation end to the discharge end of the housing and a radially inwardly disposed convex section having a progressively increasing wall thickness in the direction from the initiation end to the discharge end of the housing, wherein detonating the at least one shaped charge further comprises generating an annular detonation wave in the shaped charge; and forming a coherent jet having a hollow leading edge.

9. The method as recited in claim 8 wherein limning a coherent jet having a hollow leading edge further comprises forming a coherent jet having a hollow generally cylindrical shape.

* * * * *